US006024624A

United States Patent [19]

Lee

[11] Patent Number: 6,024,624

[45] Date of Patent: Feb. 15, 2000

[54] NOVELTY ARTICLE

[75] Inventor: Seungsoo Lee, Franklin Lakes, N.J.

[73] Assignee: Joy World, Inc., Ridgefield Park, N.J.

[21] Appl. No.: 09/050,306

[22] Filed: Mar. 30, 1998

Related U.S. Application Data

[60] Provisional application No. 60/044,552, Apr. 28, 1997.

[51] Int. Cl.[7] ..... A63H 5/00

[52] U.S. Cl. ..... 446/81; 446/202; 446/213

[58] Field of Search ..... 239/16, 18, 33; 200/182; 446/71, 81, 176, 202, 213, 267, 404, 484, 485

[56] References Cited

U.S. PATENT DOCUMENTS

| | | | |
|---|---|---|---|
| D. 163,099 | 5/1951 | Dinhofer . | |
| 1,916,646 | 7/1933 | Tycko . | |
| 2,370,931 | 3/1945 | Bogin et al. . | |
| 2,619,770 | 12/1952 | Dinhofer . | |
| 3,073,058 | 1/1963 | Lemelson . | |
| 3,122,959 | 3/1964 | Barr . | |
| 3,332,622 | 7/1967 | Lombard . | |
| 3,398,624 | 8/1968 | Stoessel et al. . | |
| 3,820,392 | 6/1974 | Beck et al. . | |
| 4,121,835 | 10/1978 | Garabedian . | |
| 4,137,931 | 2/1979 | Hasenbeck . | |
| 4,211,024 | 7/1980 | Nickell . | |
| 4,221,927 | 9/1980 | Dankman et al. . | |
| 4,252,273 | 2/1981 | Karterman | 239/33 |
| 4,299,041 | 11/1981 | Wilson . | |
| 4,477,249 | 10/1984 | Ruzek et al. . | |
| 4,479,329 | 10/1984 | Fraden . | |
| 4,484,582 | 11/1984 | Rottenberg et al. . | |
| 4,525,821 | 7/1985 | Garcia . | |
| 4,529,390 | 7/1985 | Levy et al. . | |
| 4,568,269 | 2/1986 | Lin . | |
| 4,631,715 | 12/1986 | Hoover . | |
| 4,704,934 | 11/1987 | Nosrati . | |
| 4,726,518 | 2/1988 | Martina et al. . | |
| 4,804,323 | 2/1989 | Kim . | |
| 4,854,712 | 8/1989 | Mori . | |
| 4,860,592 | 8/1989 | Van Emden et al. . | |
| 4,910,647 | 3/1990 | Gong . | |
| 5,015,175 | 5/1991 | Lee . | |
| 5,038,476 | 8/1991 | McCrea . | |
| 5,108,338 | 4/1992 | Margolis . | |
| 5,280,905 | 1/1994 | Micco . | |
| 5,304,084 | 4/1994 | Liao . | |
| 5,361,987 | 11/1994 | Matheussen e tal. | 239/33 |
| 5,363,590 | 11/1994 | Lee . | |
| 5,487,658 | 1/1996 | Lee . | |
| 5,648,129 | 7/1997 | Lee . | |
| 5,671,863 | 9/1997 | Uliana | 220/710 |
| 5,785,406 | 7/1998 | Lee | 362/96 |
| 5,806,765 | 9/1998 | Weinstein | 239/33 |

FOREIGN PATENT DOCUMENTS

| | | |
|---|---|---|
| 63-118868 | 8/1988 | Japan . |
| 9417691 | 8/1994 | WIPO . |

*Primary Examiner*—Robert A. Hafer
*Assistant Examiner*—Jeffrey D. Carlson
*Attorney, Agent, or Firm*—Selitto & Associates

[57] ABSTRACT

A novelty article for use in connection with liquid has a body and a generating mechanism, which is attached to the body, for generating electrically produced special effects, such as audible sounds and visible lights, so as to enhance amusement for a user. The generating mechanism is provided with an activating mechanism, which is attached to the body, for activating the generating mechanism in response to contact by liquid. In accordance with one feature of the present invention, the body includes a drinking straw having a passageway for liquid. The activating mechanism has a pair of electrical contacts positioned in the passageway so as to activate the generating mechanism in response to liquid flow through the passageway.

15 Claims, 6 Drawing Sheets

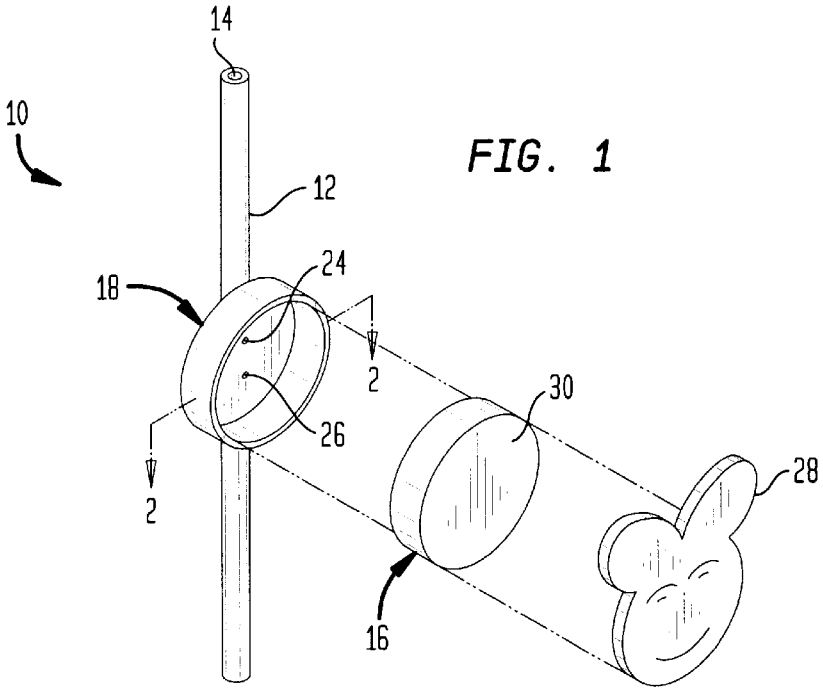
FIG. 1
FIG. 2
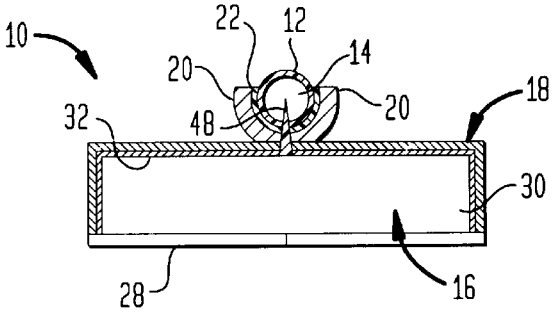
FIG. 3
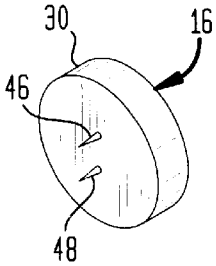

NOVELTY ARTICLE

CROSS REFERENCE TO RELATED APPLICATIONS

This is a §111 (a) application relating to U.S. application Ser. No. 60/044,552 filed Apr. 28, 1997.

FIELD OF THE INVENTION

The present invention relates to novelty articles and, more particularly, novelty articles adapted to generate special effects, such as audible sounds or visible lights.

BACKGROUND OF THE INVENTION

Articles adapted to generate special effects, such as musical melodies or visible lights, can be useful for amusement purposes. For instance, drinking straws adapted to produce audible sounds and/or lights in response to liquid flow therethrough can enhance amusement at social gatherings, especially at birthday parties for children. While various drinking straws have been developed to generate special effects (see, for instance, U.S. Pat. Nos. 3,122,959, 3,332,622, 3,398,624, 4,121,835, 4,252,273 and 4,631,715), none of them are adapted to produce electronically generated audible sounds and/or visible lights in response to liquid flow therethrough. Accordingly, there is a need for a drinking straw adapted to produce such audible sounds and/or visible lights.

SUMMARY OF THE INVENTION

The present invention overcomes the disadvantages and shortcomings of the prior art discussed above by providing a new and improved novelty article used in connection with liquid. More particularly, the novelty article has a body and a generating mechanism, which is attached to the body, for generating electrically produced special effects, such as audible sounds and visible lights, so as to enhance amusement for a user. The generating mechanism is provided with an activating mechanism, which is attached to the body, for activating the generating mechanism in response to contact by liquid. The activating mechanism includes a pair of electrical contacts for activating the generating means when the electrical contacts come in contact with liquid.

In accordance with one feature of the present invention, the body includes a drinking straw having a passageway for liquid. The electrical contacts are positioned in the passageway so as to activate the generating mechanism in response to liquid flow through the passageway.

In accordance with another feature of the present invention, the body is sized and shaped so as to float on liquid or to be submerged in same. The electrical contacts are mounted on the body in such a position that the electrical contacts are in contact with liquid when the body is placed on or in liquid.

Yet another feature of the present invention involves providing the body with a spoon. More particularly, the spoon has a head, on which the contacts are mounted, whereby the generating mechanism generates special effects when the head is submerged in liquid.

BRIEF DESCRIPTION OF THE DRAWINGS

For a more complete understanding of the present invention, reference is made to the following detailed description of various exemplary embodiments considered in conjunction with the accompanying drawings, in which:

FIG. 1 is an exploded perspective view of a novelty article constructed in accordance with a first embodiment of the present invention;

FIG. 2 is a cross-sectional view, taken along section line 2—2 and looking in the direction of the arrows, of the novelty article shown in FIG. 1;

FIG. 3 is a perspective view, looking from behind, of an electronic circuit module of the novelty article shown in FIGS. 1 and 2;

DETAILED DESCRIPTION OF THE EXEMPLARY EMBODIMENTS

Figure 4:
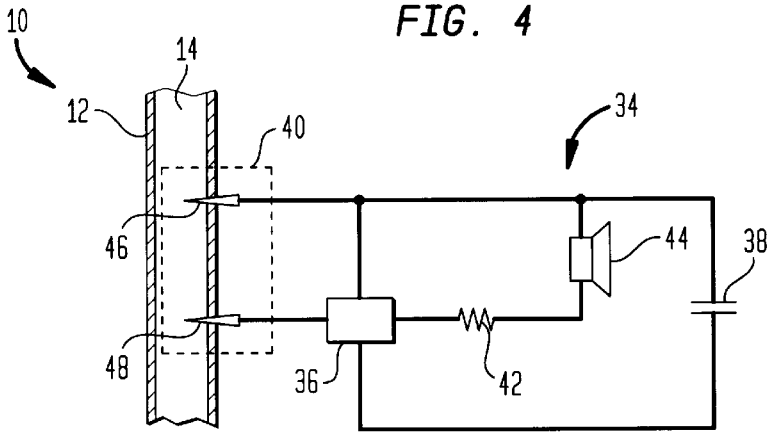
FIG. 4 is a schematic view of an electronic circuit assembly which is utilized in the novelty article shown in FIGS. 1 and 2.

FIGS. 1 and 2 show a novelty article 10 constructed in accordance with a first embodiment of the present invention. More particularly, the novelty article 10 includes a drinking straw 12, which has a passageway 14 therethrough, and an electronic or electrical circuit module 16 adapted to produce an electronically or electrically generated audible sound in response to liquid flow through the passageway 14 of the straw 12 as will be discussed in greater detail hereinafter. A receptacle 18 is attached to the straw 12 for mounting the electronic circuit module 16 to the straw 12. The receptacle 18 has a pair of clips 20 for fastening same to the straw 12 (see FIG. 2). The clips 20 are sized and shaped so as to grip a portion of the straw 12 therebetween. In order to permanently fasten the receptacle 18 to the straw 12, glue 22 is preferably applied between the clips 20 and the straw 12 (see FIG. 2). The receptacle 18 also includes a pair of openings 24, 26 formed on a bottom wall of the receptacle 18 for purposes to be discussed hereinafter. Moreover, a figure or face plate 28, which has an amusing image thereon, is secured to the electronic circuit module 16 for visual effect.

With reference to FIGS. 3 and 4, as well as FIGS. 1 and 2, the electronic circuit module 16 includes a housing 30 and an electronic or electrical circuit assembly 34 contained in the housing 30. More particularly, the housing 30 is sized and shaped so as to be received in the receptacle 18 and is permanently attached to same by glue 32 (see FIG. 2) applied between the electronic circuit module 16 and the receptacle 18. Because the novelty article 10 is adapted to be reused, the housing 30 houses the electronic circuit assembly 34 in a fluid-tight manner so as to prevent cleaning fluid, such as water, from entering the housing 30 when the novelty article 10 is washed and/or rinsed with such fluid after use.

With particular reference to FIG. 4, the electronic circuit assembly 34 is provided with an integrated circuit unit 36 (hereinafter referred to as "ICU"), a power source 38 (e.g., a battery), a sensor mechanism or activating mechanism 40, a resistor 42 and a speaker 44 for producing audible sounds. More particularly, the sensor mechanism 40, which is connected to the ICU 36 for activating same, includes a pair of electrical contacts 46, 48 projecting outwardly from the housing 30 and sized and shaped so as to extend through the openings 24, 26, respectively, of the receptacle 18 (see also FIGS. 1–3). Moreover, the contacts 46, 48 have needle-like (i.e., pointed) free ends adapted to puncture the straw 12 when the electronic circuit module 16 is forced into the receptacle 18 and to thereby position the contacts 46, 48 in the passageway 14 of the straw 12 (see FIGS. 2 and 4). The electronic circuit module 16 is preferably received in the receptacle 18 before the glue 22 cures such that when the contacts 46, 48 penetrate through the straw 12, the glue 22 seals around the contacts 46, 48 and thereby seals any gaps formed between the contacts 46, 48 and the straw 12 in an air-tight manner. In this manner, liquid flowing through the straw 12 is prevented from seeping out from the passageway 14 through such gaps, while air is prevented from being sucked through same during the use of the article 10. Alternatively, sealing gaskets can be positioned between the straw 12 and the receptacle 18 and/or between the receptacle 18 and the housing 30 of the electronic circuit module 16 to perform the sealing function. By extending through the straw 12, the contacts 46, 48 cooperate with the straw 12 to maintain the receptacle 18 and hence the electronic circuit module 16 in proper position relative to the straw 12.

Still referring to FIG. 4, the ICU 36, the construction of which is well known in the electronic art, is adapted to be activated when electrolytic liquid, such as fruit juice and soda, flowing through the passageway 14 of the straw 12 comes in contact with both of the contacts 46, 48 and thereby completes the circuit associated with the contacts 46, 48 (i.e., the contacts 46, 48 are electrically closed by the liquid). In other words, the contacts 46, 48 activate the ICU 36 in response to contact by liquid flowing through the passageway 14. In this regard, the resistor 42 is connected to the ICU 36 for controlling the trigger sensitivity of the electronic circuit assembly 34. More particularly, the resistor 42 is provided so as to make the sensor mechanism 40 sensitive enough to activate the ICU 36 when the contacts 46, 48 are interconnected and are thereby electrically closed by such liquid. That is, the resistance of the resistor 42 is selected so as to activate the ICU 36 when the contacts 46, 48 are electrically closed by electrolytic liquid, such as fruit juice and soda, having relatively low electric current-conducting characteristics. For this purpose, the resistance of the resistor 42 is preferably in a range of between about 300,000 ohms and about 600,000 ohms and is more preferably about 500,000 ohms. In this regard, it should be noted that the resistance of the resistor 42 should not be too high as to unintentionally activate the ICU 36, thereby preventing inadvertent or unwanted activation of the ICU 36.

The ICU 36 is preprogrammed with electronic signals that are converted to audible tones, messages or sounds through the speaker 44. More particularly, the ICU 36 contains programs that play one or more of complete cycles of preprogrammed electronic signals of audible tones or messages when the contacts 46, 48 are electrically closed to activate the ICU 36. The ICU 36 is preferably programed so that it completes the preprogrammed cycle or cycles even when the contacts 46, 48 are opened before the completion of the programmed cycle. However, different needs may require that the playing duration of the electronic signals that are programmed in the ICU 36 correspond to the closing sequence and duration of the contacts 46, 48. Additionally, if there is a specific requirement to have the electronic signals from the ICU 36 and, correspondingly, the auditory message therefrom to respond to the closing sequence and duration of the sensor mechanism 40, it may be desirable to program the ICU 36 to reset itself to the initial stage of its programmed cycle when the sensor mechanism 40 is opened after the activation of the ICU 36.

The power source 38 is selected to properly accommodate the requirements of the electronic circuit assembly 34, especially the ICU 36. In accordance with the convention of the relevant electronic circuit art, the ICU 36 preferably has a 1.5 volt circuitry, and the preferred power source potential is therefore 1.5 volt.

In use, the drinking straw 12 is used in a conventional manner. When liquid, such as fruit juice or soda, is sucked through the passageway 14 of the straw 12, the liquid flowing through the passageway 14 comes in contact with both of the contacts 46, 48 and interconnects them. As a result, the liquid completes the circuit associated with the contacts 46, 48 (i.e., electrically closes the contacts 46, 48) and thereby activates the ICU 36, causing the speaker 44 to produce the preprogramed audible tones, messages or sounds. In this manner, the novelty article 10 is adapted to enhance amusement at social gatherings, such as birthday parties for children.

It should be noted that the present invention can have numerous modifications and variations. For instance, the receptacle 18 can be removably mounted on the straw 12, thereby allowing the straw 12 to be discarded after use while permitting the receptacle 18 and the electronic circuit module 16 to be reused on another straw. In such circumstances, the receptacle 18 and the electronic circuit module 16 can be integrally formed as a single unit. To removably mount the receptacle/electronic circuit module on a disposable straw, a clip, which is adapted to wrap completely around a portion of the straw 12 in a locking manner, can be used. In this connection, when such a clip is locked around a straw, the contacts 46, 48 are caused to penetrate through same and thereby facilitate in holding the receptacle/electronic circuit module in place (i.e., prevent the receptacle/electronic circuit module from moving longitudinally relative to the straw). The drinking straw 12 can also have different shapes (e.g., a curved shape), rather than a linear shape.

The electronic circuit assembly 34 can also have numerous modifications and variations. For instance, many different types of circuitry can be utilized in connection with the novelty article 10. Further, because the resistance of the resistor 42 is dependent upon the overall circuitry of the electronic circuit assembly 34, it can be selected from a resistance range different from the range mentioned above. In addition, the relative position of the resistor 42 in the circuitry of the electronic circuit assembly 34 is not critical. For example, the resistor 42 can be incorporated into the ICU 36. Moreover, the sensor mechanism 40 can be replaced by a switch mechanism adapted to activate the ICU 36. For instance, the sensor mechanism 40 can be replaced by a switch mechanism mounted within the passageway 14 of the straw 12 and adapted to be mechanically actuated in response to liquid flow through same or by an external switch mechanism adapted to be mechanically and/or manually actuated by a user. Moreover, the contacts 46, 48 can be provided with dull free ends. In such circumstances, openings can be preformed in the straw 12 so as to allow the contacts 46, 48 to extend into the passageway 14 of the straw 12.

In addition to the foregoing modifications and variations, the receptacle 18 can be completely eliminated (i.e., the electronic circuit module 16 can be mounted directly to the straw 12). As noted above, the electronic circuit module 16 and the receptacle 18 can be formed as a single unit. Moreover, the electronic circuit module 16 can be removably received in the receptacle 18. Further, the electronic circuit assembly 34 and/or the ICU 36 can be provided with a recording mechanism for allowing audible sounds, such as voice messages, to be recorded and played back when the ICU 36 is activated. The electronic circuit assembly 34 can also be provided with additional electrical components, such as an amplifier for the speaker 44. Moreover, the electronic circuit assembly 34 can be designed to provide additional special effects, such as visual effects, by providing a light unit adapted to be activated upon activation of the ICU 36. Further, the clips 20 can be replaced with other types of mounting mechanisms.

FIG. 5, FIG. 6, FIG. 7, FIGS. 8–11, FIGS. 12 and 13 and FIG. 14 depict second, third, fourth, fifth, sixth and seventh embodiments, respectively, of the present invention. Elements illustrated in FIG. 5, FIG. 6, FIG. 7, FIGS. 8–11, FIGS. 12 and 13 and FIG. 14, which correspond, either identically or substantially, to the elements described above with respect to the embodiment of FIGS. 1–4 have been designated by corresponding reference numerals increased by one hundred, two hundred, three hundred, four hundred, five hundred and six hundred, respectively. Unless otherwise stated, the embodiments of FIGS. 5–14 are constructed and assembled in the same basic manner as the embodiment of FIGS. 1–4.

Figure 5:
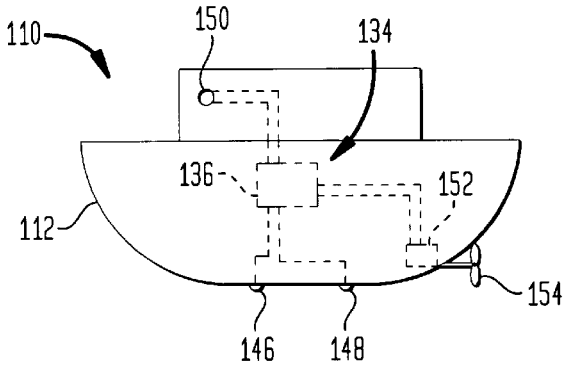
FIG. 5 is a side elevational view of a novelty article constructed in accordance with a second embodiment of the present invention.

With reference to FIG. 5, a novelty article 110 has a boat-shaped body 112 adapted to float on liquid, such as water, or to be submersible in liquid. More particularly, the novelty article 110 is adapted for use, for instance, as a toy in a bath tub, a swimming pool or the like. The body 112 is provided with an electronic circuit assembly 134 housed therein. More particularly, the electronic circuit assembly 134 includes an ICU 136 and a pair of electrical contacts 146, 148, which are connected to the ICU 136. The contacts 146, 148 are positioned on the body 112 in such a position that they are in contact with liquid when the body 112 is placed on or in liquid. In this regard, the contacts 146,148 are mounted on a bottom side of the body 112. The body 112 is also provided with a light unit 150 which is connected to the ICU 136 so as to be activated by same for providing visual effects. A motor 152 is mounted within the body 112 and has a propeller 154 for causing the body 112 to move forward when the motor 152 is activated by the ICU 136. The body 112 also includes a speaker (not shown) for producing an audible sound, such as a boat sound, and a power unit (not shown), such as a battery. When the article 110 is placed on liquid, the contacts 146, 148 are electrically closed by the liquid, thereby activating the ICU 136. As a result, the light unit 150 is activated to provide visual effects, and the motor 152 is activated to cause the propeller 154 to rotate, thereby causing the body 112 to move.

Figure 6:
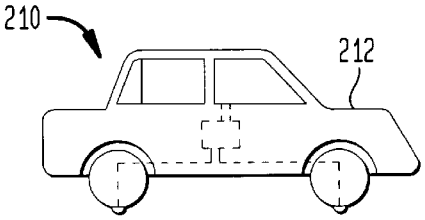
FIG. 6 is a side elevational view of a novelty article constructed in accordance with a third embodiment of the present invention.

FIG. 6 shows a novelty article 210 identical to the novelty article 110 shown in FIG. 5, except that a body 212 of the novelty article 210 is in the form of automobile and that the body 212 is not provided with a motor or a propeller similar to those utilized in the novelty article 110 of FIG. 5.

Figure 7:
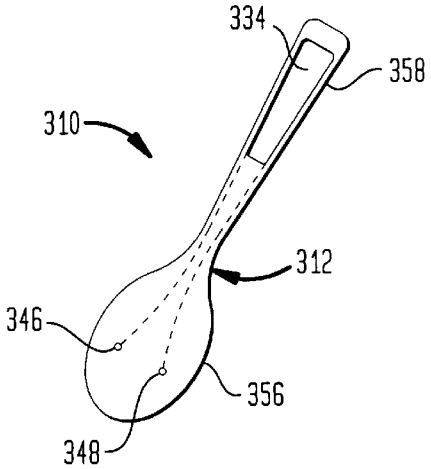
FIG. 7 is a perspective view of a novelty article constructed in accordance with a fourth embodiment of the present invention.

FIG. 7 shows a novelty article 310 which includes a spoon 312 provided with a head 356 and a handle 358. An electronic circuit assembly 334 is mounted on the spoon 312. More particularly, the electronic circuit assembly 334 includes an ICU (not shown), a battery (not shown) and a speaker (not shown), all of which are electrically connected to each other. Contacts 346, 348 are mounted on the head 356 and connected to the ICU for activating same and to thereby cause the speaker to produce audible sounds.

In use, when the head 356 of the spoon 312 is immersed or submerged in liquid, such as water or milk, the contacts 346, 348 are electrically closed, thereby activating the ICU. As a result, the speaker of the electronic circuit assembly 334 produces preprogramed sounds.

It should be noted that the novelty article 310 can have many variations and modifications. For instance, the spoon 312 can be replaced by various other types of utensils, such as a fork or a knife. In addition, the electronic circuit assembly 334 can include additional devices for creating other special effects, such as a light unit.

Figure 8:
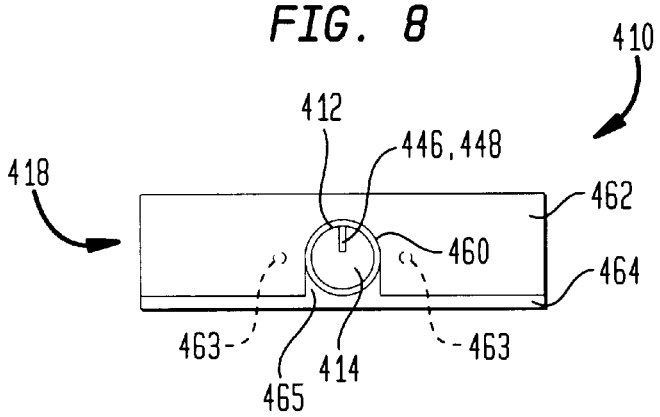
FIG. 8 is a top plan view of a novelty article constructed in accordance with a fifth embodiment of the present invention.
Figure 9:
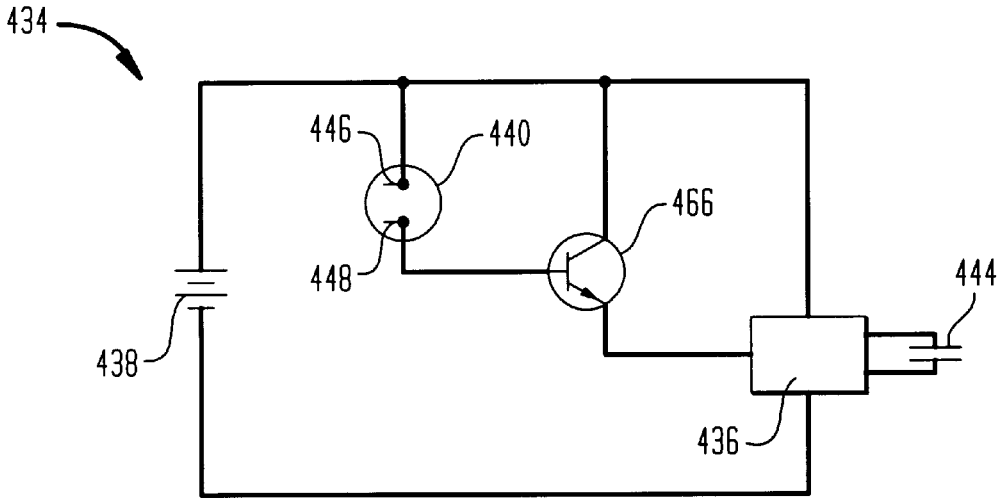
FIG. 9 is a schematic view of an electronic circuit assembly which is utilized in the novelty article shown in FIG. 8.
Figure 10:
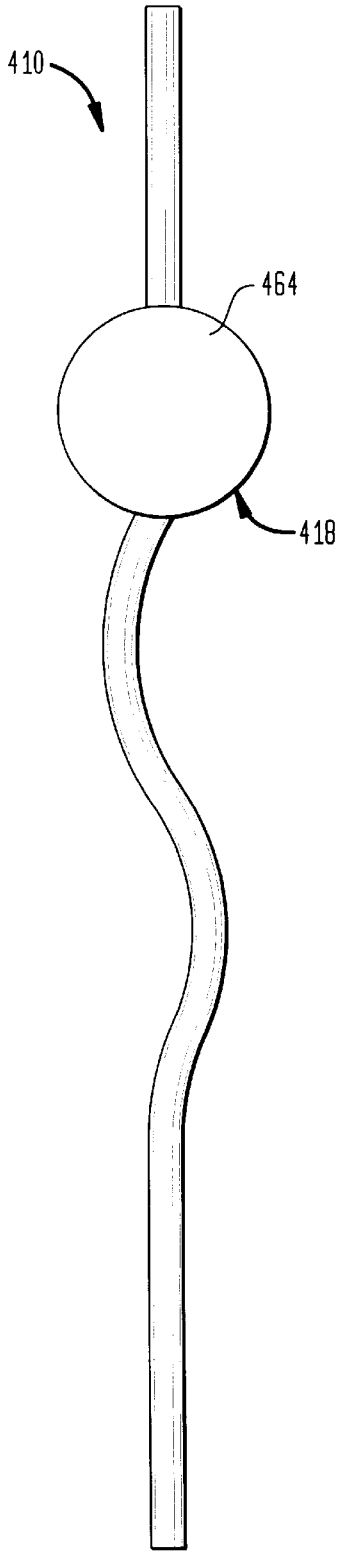
FIG. 10 is a front elevational view of the novelty article shown in FIG. 8.
Figure 11:
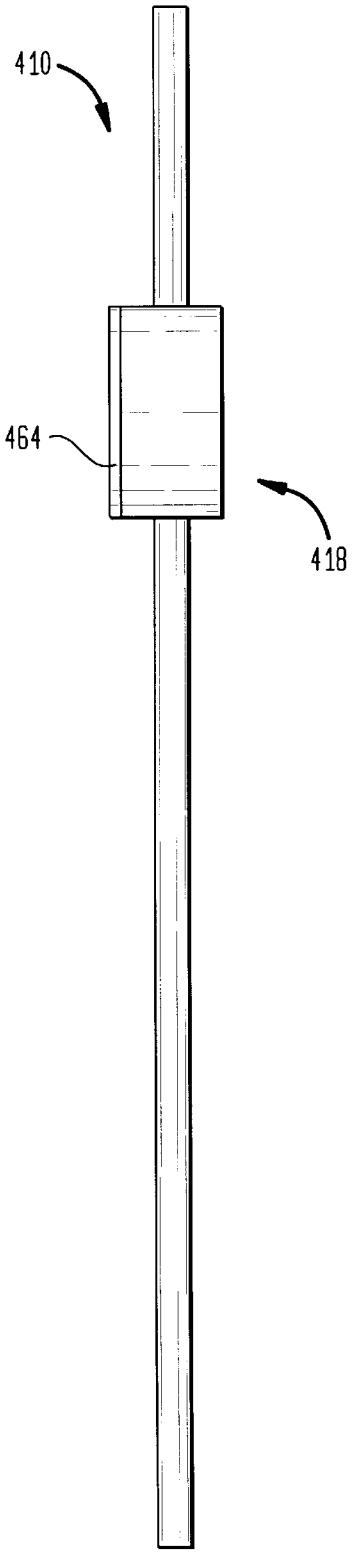
FIG. 11 is a side elevational view of the novelty article shown in FIGS. 8 and 10.

FIGS. 8–11 show a novelty article 410 which is constructed and operated in the same basic manner as the embodiment shown in FIGS. 1–4, except as follows. The novelty article 410 has a drinking straw 412, which has a curved shape, and a receptacle 418 for housing an electronic or electrical circuit assembly 434 therein. Unlike the electronic circuit assembly 34 of the embodiment shown in FIGS. 1–4, the electronic circuit assembly 434 is not provided with a housing similar to the housing 30 utilized in the embodiment of FIGS. 1–4 and is therefore housed directly within the receptacle 418. The drinking straw 412 extends through the receptacle 418, which is provided with opposing holes 460 (only one of which is shown in FIG. 8) formed in an annular side wall 462 of the receptacle 418. More particularly, the drinking straw 412 extends through the holes 460. Apertures 463 are also formed in the side wall 462 of the receptacle 418 adjacent a bottom portion of the side wall 462. When liquid, such as water, enters the receptacle 418, the apertures 463 allow same to drain from the receptacle 418. The apertures 463 also allow the sounds produced by the electronic circuit assembly 434 in the receptacle 418 to travel through the apertures 463 and to thereby be readily audible to a user. A cover 464 is provided so as to cover an opening (not shown) of the receptacle 418, thereby enclosing the electronic circuit assembly 434 in the receptacle 418. The cover 464 also includes a pair of tongues 465 (only one of which is shown in FIG. 8) for securing the drinking straw 412 in the holes 460. More particularly, each of the tongues 465 is sized and shaped so as to be received in a corresponding one of the holes 460.

The electronic circuit assembly 434 includes an integrated circuit unit (ICU) 436, a power source (e.g., batteries) 438, a sensor mechanism 440, a sound producing unit 444 and a transistor 466, all of which are directly or indirectly connected to each other for producing audible sounds when electrical contacts 446, 448 of the sensor mechanism 440 are electrically closed. The power source preferably has 3 volt potential. As is well known in the electronic field, the transistor 466 functions to amplify an output signal associated therewith and to thereby activate the ICU when the electrical contacts 446, 448 are electrically closed by liquid, such as soda and juice. The transistor is preferably a commercially available transistor. The ICU 436 is also preferably a commercially available integrated circuit unit (e.g., integrated circuit units marketed by Huako Electronics, Taiwan, as part number HKA5208). The sound producing unit 444 can be any type of commercially available buzzers or speakers.

In assembling the novelty article 410, the contacts 446, 448 are heated to a predetermined temperature and are then applied against the drinking straw 412, which is made from a plastic material or the like. As the contacts 446, 448 are pressed against the drinking straw 412, they melt associated portions of the drinking straw 412. In this manner, the contacts 446, 448 can easily penetrate the drinking straw 412 and can thereby be positioned in a passageway 414 of the drinking straw 412. As the contacts 446, 448 and the melted portions of the drinking straw 412 cool, the melted portions solidify and seal any gaps formed between the contacts 446, 448 and the drinking straw 412, thereby eliminating the need to provide separate sealing mechanisms, such as gaskets or glue. Once the portions of the drinking straw 412 around the contacts 446, 448 completely stiffen, they firmly hold the contacts 446, 448 in place, thereby securing the electronic circuit assembly 434 to the drinking straw 412.

It should be noted that the novelty article 410 can have many modifications and variations. For instance, as is well known in the electronic art, the electronic circuit assembly 434, as well as the other electronic circuit assemblies shown and described herein, can be modified in numerous ways to suit particular needs or requirements. The specific design of the electronic circuit assembly 434 shown in FIG. 9, as well as those of the other electronic circuit assemblies described herein, is merely exemplary and is not therefore meant to limit the scope of the present invention. For instance, the components of the electronic circuit assembly 434 can be custom-designed to combine another component therewith, to omit one or more components of the electronic circuit assembly 434 and/or to require one or more additional components. By way of example, the ICU 436 can be custom-designed to include the transistor 466 therein and/or to require a resistor similar to that of the embodiment of FIGS. 1–4. The electronic circuit assembly 434 can also be modified to produce additional or different special effects. Moreover, the contacts 446, 448 can be coated with silver or gold to enhance their electric conductivity. Other suitable coating materials may be used, provided that they are not harmful to human health. In addition, the trigger sensitivity of the ICU 436 can be set to a desired level by adjusting the physical distance between the contacts 446, 448, by positioning the contact 446 in the passageway 414 of the straw 412 at different locations relative to the contact 448 and/or by providing the electronic circuit assembly 434 with a resistor.

In addition to the electronic circuit assembly 434, the receptacle 418 can be modified. For instance, other fastening mechanisms, such as a fastener, can be used to secure the drinking straw 412 to the receptacle 418. A face plate or figure can also be mounted to the cover 464 for amusement purposes.

Figure 12:
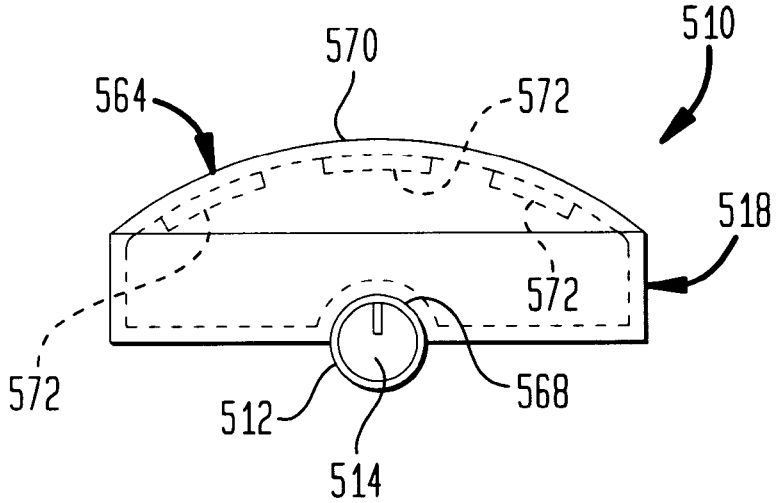
FIG. 12 is a top plan view of a novelty article constructed in accordance with a sixth embodiment of the present invention.
Figure 13:
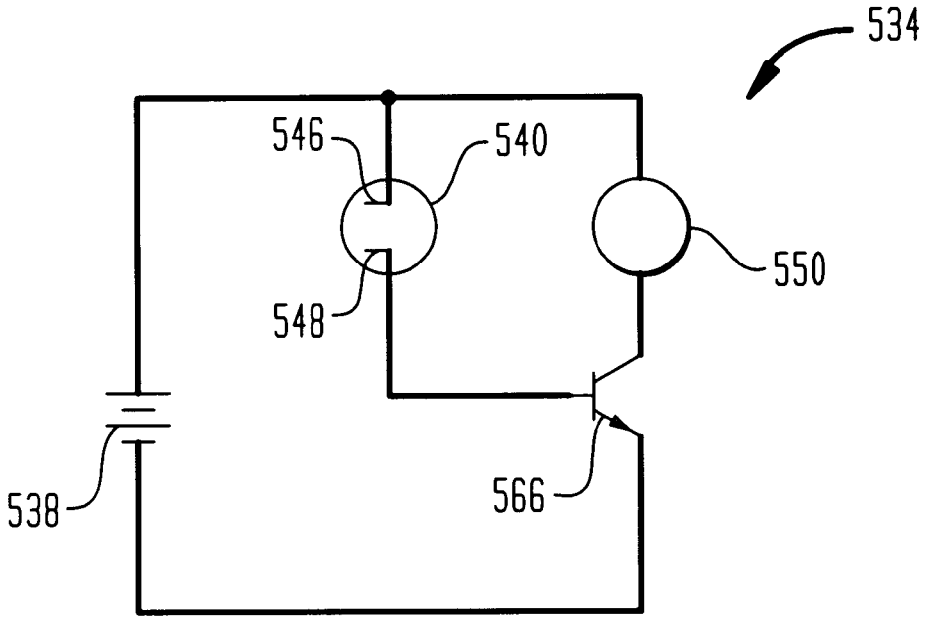
FIG. 13 is a schematic view of an electronic circuit assembly which is utilized in the novelty article shown in FIG. 12.

FIGS. 12 and 13 show a novelty article 510 which is constructed and operated in the same basic manner as the embodiment shown in FIGS. 1–4, except as follows. The novelty article 510 has a drinking straw 512 and a receptacle 518 mounted to the drinking straw 512. The receptacle 518 has a groove 568 which is formed in a rear side of the receptacle 518 and which is sized and shaped so as to receive a portion of the drinking straw 512 therein in a snap-fit manner. Alternatively, the drinking straw 512 can be secured to the receptacle 518 with other fastening mechanisms. The receptacle 518 includes a cover 564 made from a transparent or translucent material, such as an acrylic material, and having a convex surface 570. Alternatively, the convex surface 570 can be made flat. Indicia 572 are printed, painted or placed on an inner side of the convex surface 570. Because the convex surface 570 is transparent or translucent, the indicia 572 are visible to a user or a viewer through the convex surface 570. Moreover, because of its convex shape, the convex surface 570 provides a greater display surface and makes the indicia 572 more visible compared to a flat surface.

The novelty article 510 is also provided with an electronic circuit assembly 534. More particularly, the electronic circuit assembly 534 includes a power source 538, a sensor mechanism 540, a transistor 566 and a light unit 550, such as a light emitting diode (LED) or a lamp, all of which are directly or indirectly connected to each other for producing visible light. More particularly, the light unit 550, which is mounted within the receptacle 518, is activated and thereby illuminates the indicia 572 when contacts 546, 548 of the sensor mechanism 540 are electrically closed by liquid flowing through the drinking straw 512.

It should be noted that the novelty article 510 can have many modifications and variations. For instance, the indicia 572 can be printed, painted or placed on an outer side of the convex surface 570. The light unit 550 can also be mounted on an exterior surface of the receptacle 518 or on the drinking straw 512. Further, the electronic circuit assembly 534 can be designed in such a manner that the light unit 550 is continuously illuminated while the contacts 546, 548 are electrically closed by liquid. Alternatively, the electronic circuit assembly 534 can be designed in such a manner that the light unit 550 is illuminated in a blinking manner by using an appropriate integrated circuit unit (ICU) or a similar device. In addition, the electronic circuit assembly 534 can be designed to provide other visual effects. For example, the electronic circuit assembly 534 can be provided with an array of light units which are arranged in a predetermined fashion for producing illuminated indicia, such as letters or images. Moreover, the electronic circuit assembly 534 can be provided with a sound-producing mechanism, such as the one described and illustrated in connection with the embodiment of FIGS. 1–4, in addition to the light unit 550. The receptacle 518 can also be formed in other shapes (e.g., a shape of a figure, such as a person or animal) and/or can be integrally combined with a face plate, such as the face plate 28 of the novelty article 10 of the embodiment shown in FIGS. 1–4. Moreover, the drinking straw 512 can be made from a light transmitting material, such as an acrylic material, so that light can be directed outwardly from the light unit 550 through the drinking straw 512 and can thereby illuminate the drinking straw 512. This drinking straw-illuminating effect can be enhanced, for instance, by making the surface of the drinking straw 512 rough to scatter light, which travels through the drinking straw 512, in random directions. In this manner, the drinking straw 512 can be provided with a "glowing" effect.

Figure 14:
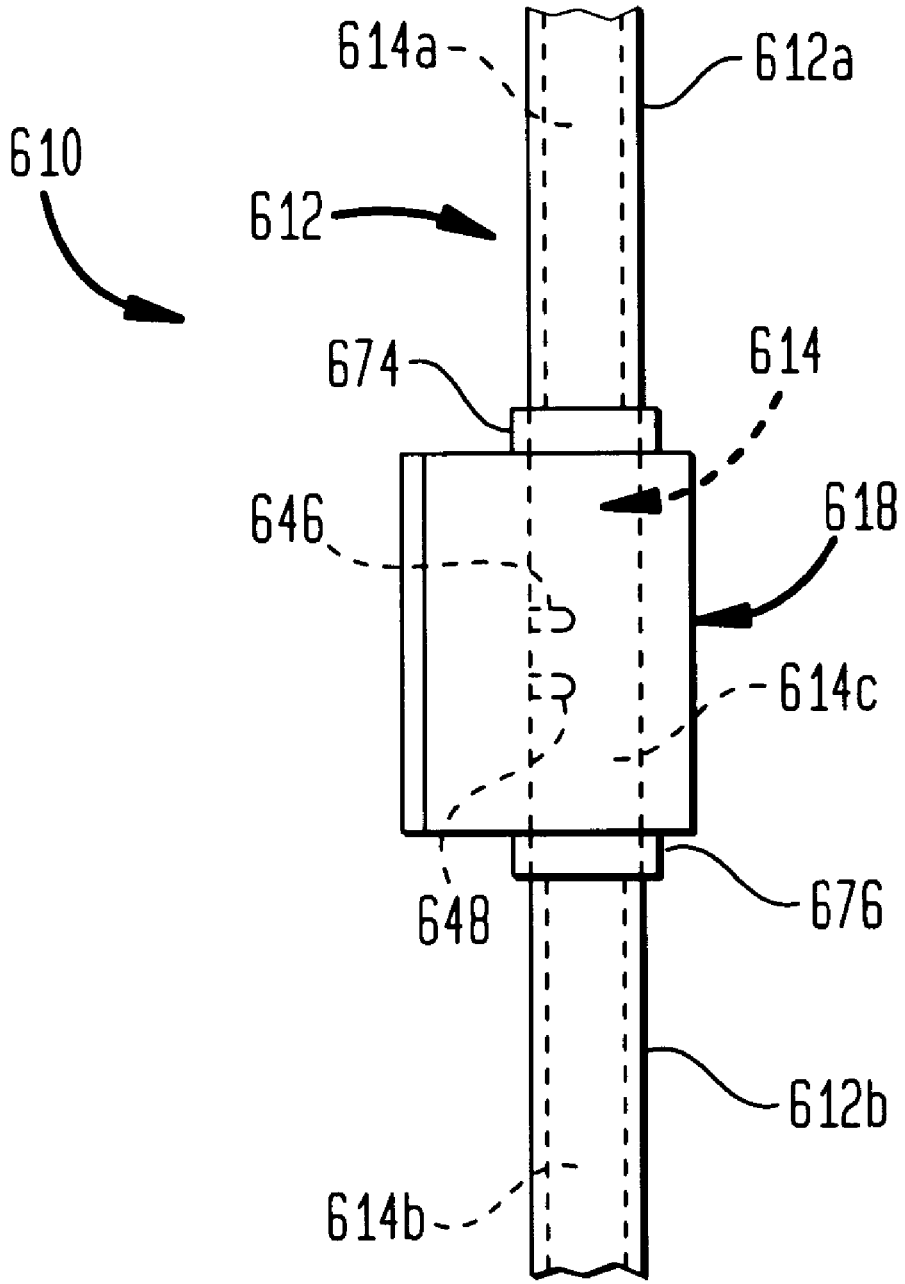
FIG. 14 is a side elevational view of a novelty article constructed in accordance with a seventh embodiment of the present invention.

FIG. 14 shows a novelty article 610 constructed in accordance with a seventh embodiment of the present invention. The novelty article 610 includes a receptacle 618 having a pair of adaptors 674, 676 projecting from opposite ends of the receptacle 618. The novelty article 610 also includes a drinking straw 612 which includes a pair of sections 612*a*, 612*b* connected to the adaptors 674, 676 of the receptacle 618. The drinking straw 612 is provided with a passageway

614 extending from a free end of the section 612*a* of the drinking straw 612 to a free end of the section 612*b* of the drinking straw 612. More particularly, the passageway 614 includes a passageway portion 614*a*, which extends through the section 612*a* of the drinking straw 612, a passageway portion 614*b*, which extends through the section 612*b* of the drinking straw 612, and a passageway portion 614*c*, which is integrally formed in the receptacle 618 and which extends through same from the adaptor 674 to the adaptor 676. In this regard, it should be noted that while the drinking straw 612 is structurally different from the drinking straw 12 of the embodiment of FIGS. 1–4, the drinking straw 612 and the drinking straw 12 are equivalent to each other. That is, the drinking straw sections 612*a* , 612*b* and the passageway portion 614*c* cooperate with one another to define a drinking straw which is equivalent to the drinking straw 12. The drinking straw sections 612*a* , 612*b* are detachable from the receptacle 618 such that the receptacle 618 and the drinking straw sections 612*a* , 612*b* are independently and separately washable. Alternatively, the drinking straw sections 612*a* , 612*b* and the receptacle 618 can be integrally or unitarily formed.

The novelty article 610 is also provided with an electronic circuit assembly (not shown in FIG. 14) having a pair of electrical contacts 646, 648 which are positioned in the passageway portion 614*c* of the passageway 614. When liquid flows through the passageway 614, the contacts 646, 648 are electrically closed and cause the electronic circuit assembly to generate electronically produced special effects.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A novelty drinking straw, comprising a body having a passageway for liquid; and generating means attached to said body for generating electrically produced special effects in response to liquid flow through said passageway, said generating means including a pair of contacts extending into said passageway through said body for actuating said generating means when said contacts are electrically closed by liquid passing through said passageway, each of said contacts having piercing means for piercing said body so as to facilitate insertion of a corresponding one of said contacts into said passageway through said body.

2. The novelty straw of claim 1, wherein said generating means includes an electrical circuit assembly connected to said contacts.

3. The novelty straw of claim 2, wherein said electrical circuit assembly includes sound-producing means for generating audible sounds when said contacts are electrically closed by liquid flowing through said passageway.

4. The novelty straw of claim 3, wherein said sound-producing means includes a speaker connected to said contacts.

5. The novelty straw of claim 4, wherein said electrical circuit assembly includes an integrated circuit unit connected to said contacts and to said speaker so as to cause said speaker to generate predetermined audible sounds when said contacts are electrically closed by liquid flowing through said passageway.

6. The novelty straw of claim 5, wherein said electrical circuit assembly includes a power source connected to said integrated circuit unit.

7. The novelty straw of claim 6, wherein said electrical circuit assembly includes a transistor connected to said integrated circuit unit and said contacts.

8. The novelty straw of claim 2, wherein said electrical circuit assembly includes light-producing means for generating visible light when said contacts are electrically closed by liquid flowing through said passageway.

9. The novelty straw of claim 8, wherein said light-producing means includes a light unit connected to said contacts.

10. The novelty straw of claim 9, wherein said electrical circuit assembly includes a power source and a transistor, both of which are connected to said contacts and said light unit.

11. The novelty straw of claim 2, further comprising housing means attached to said body for housing said electrical circuit assembly therein.

12. The novelty straw of claim 11, wherein said housing means includes a receptacle sized and shaped so as to receive said electrical circuit assembly therein.

13. The novelty straw of claim 12, wherein said housing means includes a groove formed in a side of said receptacle and sized and shaped so as to receive a portion of said body therein.

14. The novelty straw of claim 12, wherein said receptacle includes a pair of opposing openings formed on a side wall of said receptacle, said body extending through said receptacle through said openings.

15. The novelty straw of claim 12, wherein said receptacle includes a clip mounted on said receptacle and sized and shaped so as to receive a portion of said straw therein.

* * * * *